United States Patent [19]

Ovens

[11] Patent Number: 4,878,317

[45] Date of Patent: Nov. 7, 1989

[54] POWER SANDER

[76] Inventor: Melvin L. Ovens, 15855 - 84th Avenue, Surrey, British Columbia V3S 2N8, Canada

[21] Appl. No.: 72,113

[22] Filed: Jul. 10, 1987

[51] Int. Cl.[4] ..... B24B 23/04

[52] U.S. Cl. ..... 51/170 TL; 51/175

[58] Field of Search ..... 51/170 TL, 175, 170 R

[56] References Cited

U.S. PATENT DOCUMENTS

| | | | |
|---|---|---|---|
| 1,868,507 | 7/1932 | Roos | 51/170 TL |
| 2,620,775 | 12/1952 | Champayne | 51/170 TL |
| 2,635,396 | 4/1953 | Johnson | 51/170 TL |
| 2,706,368 | 4/1955 | Randolph | 51/170 TL |
| 3,399,494 | 9/1966 | Hendrickson | 51/170 TL |
| 3,722,147 | 3/1973 | Brenner | 51/170 TL |
| 4,062,152 | 12/1977 | Mehrer | 51/170 TL |

FOREIGN PATENT DOCUMENTS

| | | | |
|---|---|---|---|
| 880389 | 6/1953 | Fed. Rep. of Germany | 51/170 TL |
| 456689 | 4/1950 | Italy | 51/170 TL |
| 370269 | 4/1932 | United Kingdom | 51/170 TL |

*Primary Examiner*—Roscoe V. Parker

*Attorney, Agent, or Firm*—Christie, Parker & Hale

[57] ABSTRACT

A power sander includes a motor and a drive shaft extending from the motor. Eccentric drives are attached to the drive shaft to drive reciprocable shafts that extend outwardly from the drive shaft in opposed directions. Sander pads are mounted to reciprocate at the end of the shafts. Rotation of the motor reciprocates the reciprocable shafts to reciprocate the sander pads.

14 Claims, 1 Drawing Sheet

POWER SANDER

FIELD OF THE INVENTION

This invention relates to a power sander.

DESCRIPTION OF THE PRIOR ART

Power sanders are well-known. They are widely used by both professional craftsmen and by home handiman, particularly those interested in carpentry. They find wide applications in the installation of drywall, in carpentry and in automobile body work.

The existing machines have a number of disadvantages. Generally speaking they are difficult to operate to achieve excellent results. They are also difficult to operate in that they generate considerable vibration which, especially for professionals, introduces considerable fatigue as a professional may be operating the machine all day. Furthermore, if they are not used skillfully, they can remove excessive quantities of the material being sanded leaving either a poor finish on the workpieces or requiring a great deal of extra work to provide a good overall surface.

There have been a number of attempts to improve the operation of these sanding devices. Prior art known to applicant includes U.S. Pat. Nos. 3,399,494 to Hendrickson; 3,722,147 to Brenner; 2,620,275 to Champayne; 2,665,396 to Johnson; 2,706,365 to Randolph and 4,062,152 to Mehrer. Of the above patents, Hendrickson Champayne, Johnson and Randolph are air operated devices in which a piston reciprocates a pair of sanding devices. Mahrer discloses a drywall sanding device having an elongated handle and attached to a vacuum source.

More particularly, Hendrickson teaches a fairly complex piece of machinery in which a piston is reciprocated by a flow of air controlled by a flow-directing valve aligned with an air intake. Brenner is also an air powered device using a turbine. The turbine drives through a series of gears to a rotated disk.

Champayne teaches two reciprocating rubbing shoes but, as in many of these prior art machines, the structure in Champayne is complicated. There is positive drive of both rubbing shoes in Champayne and that drive is in opposites directions. Johnson shows a device having reciprocating pistons with a positive drive to each pad. Randolph is principally concerned with a system of lubrication for a sander and Mehrer is concerned with removing the dust formed during the sanding operation. Mehrer in particular only shows a single pad.

SUMMARY OF THE INVENTION

The present invention is directed to the provision of a sander that is simple in structure, provides excellent results, is easy to control and, in its preferred embodiment, is substantially free of vibration.

Accordingly, the present invention provides a power sander that comprises a motor; a drive shaft extending from the motor; first and second eccentric drive means attached to the drive shaft; first and second reciprocable shafts driven by the first and second eccentric drive means and extending outwardly from the drive shaft in opposed directions; first and second sander pads rotatably mounted at the end of the first and second reciprocable shafts each sander pad being pivotally mounted on a support member substantially at the center of the support member with cams mounted on the support member to enable variation of the orientation of each pad whereby rotation of the motor reciprocates the reciprocable first and second shafts to reciprocate the first and second sander pads.

In a preferred embodiment each support member includes bearings on the surface opposed to the abrasive pads and there is at least one bearing on the first support member that is axially aligned with at least one bearing on the second support member. A guide shaft then extends longitudinally through the aligned bearings on the first and second support members.

This preferred embodiment provides relative guiding of the pads as they are reciprocated and is believed to be a principal reason for the marked reduction in the vibration in this preferred embodiment.

BRIEF DESCRIPTION OF THE DRAWINGS

Aspects to the invention are illustrated, merely by way of example, in the accompanying drawings in which.

DESCRIPTION OF THE PREFERRED EMBODIMENTS

Figure 1:
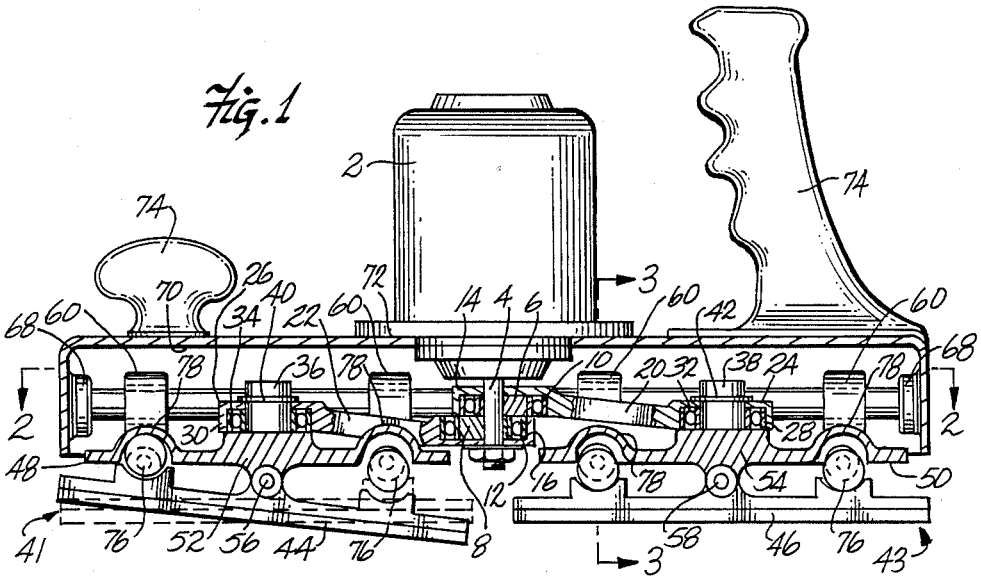
FIG. 1 is a side elevation, partly in section, of a preferred embodiment of the present invention.

The drawings show a power sander comprising a motor 2. An electric motor is illustrated. There is a drive shaft 4 extending from the motor 2. A pair of eccentric drive means are attached to the drive shaft. In the illustrated embodiment the eccentric drive means comprises a first cam 6 and a second cam 8 received within ball bearings 10 and 12. The ball bearings 10 and 12 in turn are received in housings 14 and 16 located at the end of a first reciprocable shaft 20 and a second reciprocable shaft 22. These first and second reciprocable shafts 20 and 22 extend outwardly from the drive shaft 4 in opposed directions to outer ends 24 and 26. At those outer ends shafts 20 and 22 are provided with recesses 28 and 30 to receive ball bearings 32 and 34 engaged on stub shafts 36 and 38. Circlips 40 and 42 retain the bearings 32 and 34 on the shafts 36 and 38.

The arrangement is such that rotation of the electric motor 2, and thus of the drive shaft 4, imparts a reciprocating motion to the first and second shafts 20 and 22, and thus to the first and second stub shafts 36 and 38. As indicated in FIG. 1 the arrangement is such that the stub shafts 36 and 38 reciprocate in opposed directions to each other.

The power sander according to the present invention includes a first sander pad 41 and a second sander pad 43 attached, respectively, to the end of the first reciprocable shaft 22 and the second reciprocable shaft 24. Each sander pad comprises a first abrasive pad 44 and a second abrasive pad 46 pivotable mounted on first and second support members 48 and 50. The stub shafts 36 and 38 extend upwardly from central bosses 52 and 54 on the back of each support member 48 and 50. The pads 44 and 46 are attached at pivotable joints 56 and 58 that include a pin that can be removed to enable changing of the pads 44 and 46.

Figure 2:
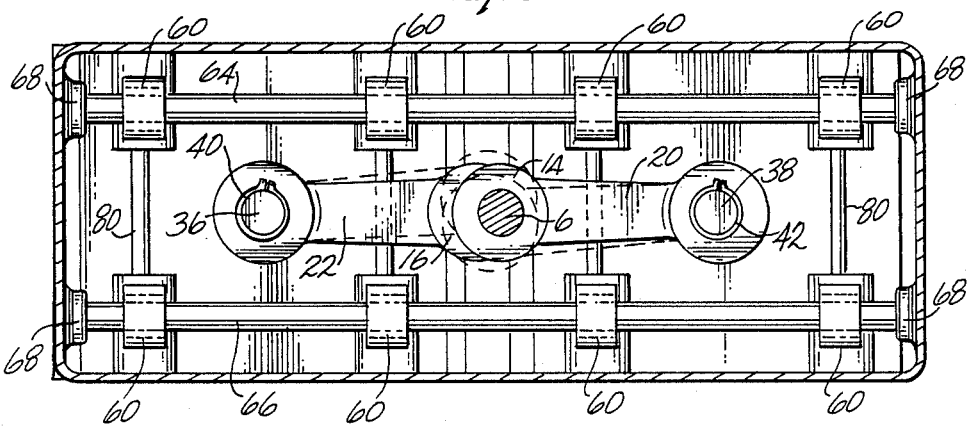
FIG. 2 is a section on the line 2—2 of FIG. 1.
Figure 3:
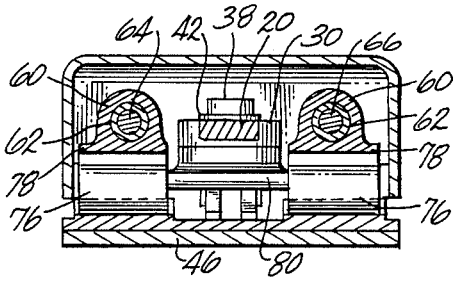
FIG. 3 is a section on the line 3—3 of FIG. 1.

As shown perhaps most clearly in FIG. 2 each support member 48 and 50 includes bearing housings 60 on the surface opposed to the abrasive pads 44 and 46. Bearing housings 60 contain plain bearings 62 (although ball bearings may also be used) to receive guide shafts 64 and 66. In the illustrated embodiment the housings 60 are arranged in pairs adjacent each side of each support member 48 and 50 with guide shafts 64 and 66 extending through housings 60, two on each support member. The support shafts 64 and 66 are located in housings 68 at their ends. Housings 68 are mounted on the interior surface of a cover 70 that receives and protects the eccentric drive means, the first and second reciprocable shafts and the like as shown, in particular, in FIG. 1. The motor 2 is mounted on the exterior of the cover 72 and the drive shaft 4 extends through the cover. As shown in FIG. 1 handle members 74 may be mounted on the cover 70. It has also been found that a handle extending from the casing of motor 2 can be desirable.

As shown in FIG. 1 the pivotal mounts at the center of each support member allow movement of the abrasive pads 44 and 46 relative to the support members 48 and 50. To facilitate this there are two cams 76 on each support member 48 and 50, adjacent an end of the support member and located in housings 78 in the support members 48 and 50. The cams 76 include means to pivot such as, for example, means to receive a wrench, an Allen key, or a simple screwdriver. Shafts 80 join pairs of cams.

To use the illustrated power sander the device is plugged into an outlet by a cable, not shown, extending from the motor 2. If a flat surface is to be sanded, as would typically be the case in drywall, then a position for the cams 76 is chosen so the abrasive pads 44 and 46 lie parallel to their support members 48 and 50, as shown to the right of FIG. 1. If some contouring is required, as may well be the case in automotive body work, then the cams may be rotated to the desired position. For example, in the left of FIG. 1 the outermost cam 76 is retracted and the innermost cam 76 extended so that the abrasive pad 44 is closer to the support member at the leading edge of the sander. When the cam positions are selected the motor is switched on. The device is held by the handles 74 provided and brought against the surface to be sanded. The rotating drive shaft 4 of the motor 2 rotates the cams 6 and 8, imparting a reciprocating motion to the first and second shafts 20 and 22 and thus to the support members 48 and 50 and abrasive pads 44 and 46. The motion imparted is such that the abrasive pads always move in a direction opposed to each other. The guide shafts 64 and 66 act to guide and control the movement of the sander pads and are believed to be instrumental in reducing the vibration to a remarkable extent. The sander is pressed against the surface to be sanded in a conventional manner. The skilled worker will realize the degree of abrasiveness required for the abrasive members.

Typically the electric motor 2 will be about one-half horsepower. The casing and the majority of the structure components may be of steel or cast alloy.

The present invention thus provides a power sander offering an extremely good results. The vibration passed to the worker using the sander is slight and the sanding of the surface is achieved with excellent results, in particular, imperfections in the sanding, such as frequently occur with the prior art machines, are not found.

I claim:

1. A power sander comprising:

a motor;

a drive shaft extending from the motor;

first and second eccentric drive means attached to the drive shaft;

first and second reciprocable shafts driven by the first and second eccentric drive means and extending outwardly from the drive shaft in opposed directions;

first and second sander pads reciprocally mounted at the end of the first and second reciprocable shafts, said sander pads comprising an abrasive pad pivotally mounted to a support member, the pivotal mount between an abrasive pad and a support member to which the abrasive pad is mounted being substantially at the center of the support member, with cams mounted on the support member to enable variation of the orientation of the pad;

whereby rotation of the motor reciprocates the reciprocable first and second shafts to reciprocate the first and second sander pads.

2. A sander as claimed in claim 1 in which the first and second eccentric drive means are arranged to drive the first and second sander pads in directions opposed to each other.

3. A sander as claimed in claim 1 in which each support member includes bearings on the surface opposed to the abrasive pads;

at least one bearing on the first support member being axially alignd with at least one bearing on the second support member 7 and a guide sbaft extending through the aligned bearings on the first and second support member

4. A sander as claimed in claim 3 which the bearings are arranged in pairs adjacent each side of each support member with a pair of guide shafts, each extending through four bearings, two on each support member.

5. A sander as claimed in claim 3 in which the bearings are plain bearings.

6. A sander as claimed in claim 3 in which the bearings are ball bearings.

7. A sander as claimed in claim 1 in which there are two cams on each support member, each cam adjacent an end of the support member.

8. A sander as claimed in claim 1 in which the cams are pivotally mounted on the support member and including means to pivot each cam.

9. A sander as claimed in claim 1 in which the eccentric drive means comprises a cam received in a rotatable bearing;

each bearing in turn being in a recess received at the end of each reciprocable shaft.

10. A sander as claimed in claim 9 in which each bearing is received in a recess at the inner end of each shaft.

11. A sander as claimed in claim 9 in which the outer rotatable attachment of each shaft comprises a rotatable bearing received in a recess at the outer end of each shaft;

a shaft extending upwardly from each sander pad to engage the bearing.

12. A sander as claimed in claim 1 that incudes a cover to receive the eccentric drive means and the first and second reciprocable shafts.

13. A sander as claimed in claim 12 in which the motor is mounted on the exterior of the cover with the drive shaft extending through the cover.

14. A sander as claimed in claim 1 including a handle.

* * * * *